United States Patent [19]

Fenton et al.

[11] Patent Number: 4,887,579

[45] Date of Patent: Dec. 19, 1989

[54] LP-GAS CARBURETION SYSTEM APPARATUS AND METHOD

[76] Inventors: Ronald L. Fenton, Wood Dale, Ill.; Robert Brandt, New York, N.Y.

[21] Appl. No.: 378,828

[22] Filed: Jul. 12, 1989

[51] Int. Cl.[4] ..... F02M 21/02

[52] U.S. Cl. ..... 123/525; 123/523

[58] Field of Search ..... 123/523, 522, 525; 165/80.3, 185; 220/88 A; 222/189

[56] References Cited

U.S. PATENT DOCUMENTS

| | | | |
|---|---|---|---|
| 4,271,809 | 6/1981 | Moore, Sr. et al. | 123/522 |
| 4,306,531 | 12/1981 | Watkins | 123/525 |
| 4,476,841 | 10/1984 | Duckworth | 123/523 |
| 4,506,647 | 3/1985 | Geddes et al. | 123/523 |

*Primary Examiner*—E. Rollins Cross

*Attorney, Agent, or Firm*—Douglas B. White

[57] ABSTRACT

Generally there is provided a LPG fuel delivery system having a tank containing a thermally conductive mesh filler adhered to the tank walls by a thermally conductive adhesive. A vapor draw fuel line is fed from the tank to a pressure regulator and then to the carburetor of the engine. The tank apparatus mesh insert is a metal lattice formed from a thin aluminium sheet by a slitting process, where the slits are expanded to provide openings with transverse sides. When the sheet is rolled or combined with other sheets, it functions to thermally contact the adjacent layers and the tank walls. Ambient heat absorbed by the tank wall is tansferred through the adhesive to the filler and is distributed to the fuel to cause a consistant high vaporization and generate pressure.

14 Claims, 2 Drawing Sheets

LP-GAS CARBURETION SYSTEM APPARATUS AND METHOD

BACKGROUND OF THE INVENTION

1. Field of the Invention

This invention relates generally to internal combustion engines and the carburetion and fuel systems required therefor. More particularly, this invention relates to improvements in the methods and apparatus for the use of LP-Gas, such as propane, in internal combustion engines used with vehicles. Even more specifically, this new method and apparatus improves the ability of the fuel system to generate a vapor and maintain the requisite vapor pressure in a fuel line through improvements in the tank design.

2. Description of the Prior Art

LP-Gas (liquid petroleum gas) has been available and has been used as a fuel for internal combustion engines since the early 1900's, following the development of propane and butane. LP-Gas vaporizes at a lower temperature than gasoline and is therefore handled differently; it is kept under a higher pressure, drawn from the tank as a liquid, and then vaporized prior to injection into the engine. Since LP-Gas vaporizes at a low temperature this vaporization tendency has created quite a problem; as long as the low temperature and high pressure remain in balance, the fuel will remain a liquid. But when the pressure drops—such as when vapor is withdrawn or when fuel is withdrawn too rapidly—then the remaining fuel boils and causes the temperature to drop, to "freeze" the fuel supply system. To help avoid this difficulty, the technique currently in use in LP-Gas systems is to withdraw the fuel as a liquid, maintain the fuel in the liquid state until reaching the engine vicinity, and then vaporizing the fuel.

Because LPG fuel is clean burning a functional LPG system presents an attractive alternative to gasoline. In a gasoline system it is well known to withdraw the liquid fuel from the tank and then to create a fine mist at the carburetor. Then typically the fuel will substantially, though not entirely, vaporize when entering the intake manifold. In this regard especially, propane has been considered superior because it will vaporize more easily and more completely. The need for cold starting aids is eliminated and it mixes well with air for a cleaner and more efficient combustion. The overall result, to the extent the propane system is feasible, is an environmentally preferred fuel.

Propane fuel tanks differ from gasoline tanks in that they are designed with heavy gauge steel to withstand the high pressures. The usual propane system also employs a pressure relief valve, a manual shut-off valve on the fuel line, a filler valve and guages. Since the fuel system is maintained in a pressurized condition, no fuel pump is used. The key to the prior systems, however, is the vaporizer-regulator. A good discussion of the vaporizer-regulator and the state of the art in LP-Gas fuel delivery systems is provided in the publication LP-GAS CARBURETION available from the National LP-Gas Association (NLPGA) located in Oakbrook, Ill.

The vaporizer-regulator used in LPG systems acts to vaporize the liquid fuel before directing it into the intake manifold. This device is used to avoid injecting the liquid drawn from the tank directly into the engine. Drawing vapor, as an alternative, has been avoided as being unreliable since the vapor pressure varies greatly with the ambient conditions and drops quickly when the vapor is drawn off, thereby rendering the system inoperative. And injecting liquid into the manifold has been avoided since it interferes with the engine operation. The prior art solution is the location of a vaporizer near the carburetor. This vaporizer is composed of a chamber into which the liquid fuel is fed under tank pressure and around which there are provided heating coils. Heated coolant from the engine cooling system is circulated through the coils to heat the chamber. Before entering the vaporizer chamber, however, the fuel is first passed through a pressure regulator to reduce the pressure to a value more acceptable to the engine—typically 10 psi—and such regulator may also employ a vacuum controlled fuel shutoff. Such a regulator is described in U.S. Pat. No. 2,775,981 and is available from Beam Products Mfg., Co.

Under cold operating conditions or high fuel demand requirements, the above described prior art apparatus will encounter a drop in fuel line pressure and a freezing of the fuel lines and of the system. This limit on the operability of the LPG system is partially responsible for its limited popularity; it limits the ambient temperatures in which it can be operated as well as limiting the size of the engine and power available. Moreover, the vaporizer device itself has contributed to the higher expense of the LPG system. Prior to the present invention no apparatus has been proposed for inexpensively vaporizing the LPG and eliminating the vaporizer device. Perhaps most importantly is that no apparatus has been proposed which allows for the high volume withdrawal of vapor from the tank without the risk of a critical pressure drop and a freeze up of the system.

SUMMARY OF THE INVENTION

Accordingly, it is a principal object and purpose of this invention to provide an improved LPG fuel system for internal combustion engines and particularly those used in vehicles.

It is a further and more specific object to provide such an improved system which functions to maintain the fuel vapor pressure at acceptable levels under a wide variety of fluctuating ambient conditions.

It is yet a further object of the present invention to provide means for vaporizing the fuel without the use of an expensive vaporization device such as that which has been known to the prior art.

In yet a further advantage it is an object of the apparatus employed with the present invention to provide explosion supression characteristics while at the same time improving the thermal capabilities of the tank apparatus.

Generally there is described herein a LPG fuel system consisting of a tank having a thermally conductive insert of a mesh material adhered to and thermally connected to the tank walls. This functions to draw the ambient heat from the side walls into the LPG fuel to cause vaporization at a higher rate for given ambient temperatures, to thereby maintain the vapor pressure in the fuel line at a consistantly higher pressure. This vapor line is then fed to a pressure regulator, then to the air-fuel mixer (carburetor), and then to the intake manifold for combustion.

The mesh insert of the tank apparatus employs, in the preferred embodiment, a metal lattice formed from a thin aluminium sheet by a slitting process in which an array of slits are arranged across the sheet. Once slit, the sheet is pulled to expand and to open the slits to thereby provide openings with transverse sides; and when combined with other sheets, or rolled, the lattice functions to thermally contact adjacent layers as well as the tank walls while only partially filling the tank void. The fuel in the tank circulates through the interstices of the lattice where it is in contact with the thermally conductive mesh. Ambient heat is absorbed by the tank wall and transferred through a thermally conductive adhesive to the mesh insert where it is distributed to the fuel. Vapor under pressure is thereby made available to be drawn off the top on demand and piped to the regulator without risk of loss of critical pressure or freeze-up of the system.

Other objects and advantages will become apparent upon reading the following detailed description and upon reference to the drawings.

While the invention will be described in connection with a preferred embodiment, it will be understood that it is not our intent to limit the invention to that specific embodiment. On the contrary, it is our intent to cover all alternatives, modifications and equivalents as may be included within the spirit and scope of the invention as determined by the claims.

DESCRIPTION OF THE PREFERRED EMBODIMENT

Figure 1:
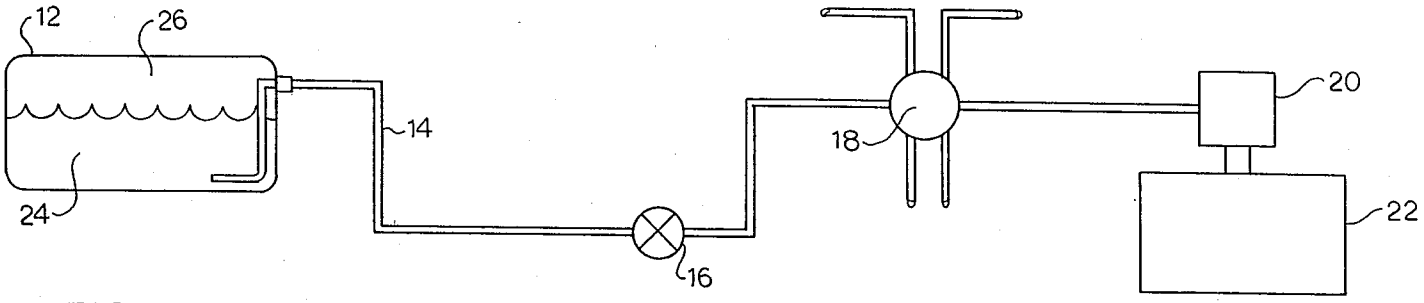
FIG. 1 is a block diagram of the prior art system employing the LPG fuel system for an internal combustion engine. This drawing shows the prior art relation of the tank, the conduit for liquid draw, the vaporizer-regulator, and the engine carburetor.

Turning first to the prior art system shown in FIG. 1, there is depicted a LPG fuel system feeding liquid fuel from a tank 12, via a conduit 14, through a lock-off valve 16, to a vaporizer-regulator 18. From there the vaporized fuel is directed to the carburetor 20 and engine 22.

The tank 12 is shown in its usual configuration, having a partial volume of liquid 24 and a superimposed volume of vapor 26. This vapor is generated as a natural result of the surface evaporation of the fuel in the tank, and is dependent on the temperature of the fuel. This functions to pressurize the system and force liquid fuel to the vaporizer-regulator. When the fuel is withdrawn, the pressure in the tank and in the fuel line drops, thus limiting the volume demand that can be placed upon the system. Withdrawal of fuel at too high a rate causes the pressure to fall to a level at which the vaporizer-regulator will not receive enough fuel to allow normal operation. At the same time the temperature of the tank and the temperature of the remaining liquid fuel drops to an extremely low temperature. As a result the system becomes temporarily inoperative until the pressure and temperature slowly rebuild. This fluctuation of the pressure and temperature is also responsible for the observed inability of the system to fully discharge the tank, since as the liquid level drops the propensity of the fuel to develop its vapor pressure declines.

Figure 2:
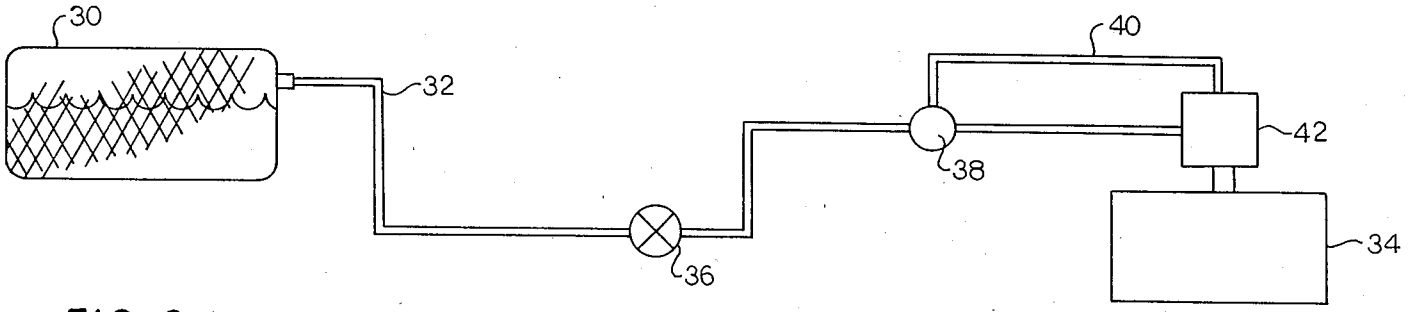
FIG. 2 is a block diagram of the apparatus, system and method of the present invention showing the tank with a thermally conductive insert adhered within the tank and providing a vapor draw conduit to a pressure regulator.

The fuel system in accordance with the present invention is shown in FIG. 2 wherein a thermally absorbant tank 30 is employed to capture ambient heat and transmit this heat throughout the liquid fuel. As a result, a vapor is developed in the tank which is more consistant and dependable, and which doesn't fluctuate as radically with fuel withdrawal. The vapor is drawn off through conduit 32 and fed to the engine 34 through a manual or solenoid controlled lock-off valve 36 and a pressure regulator 38. This pressure regulator may be provided with a vacuum controlled shut-off through vacuum line 40 leading from the carburetor 42 back to the regulator in accordance with prior practice, to close the fuel line when the engine stops.

Figure 3:
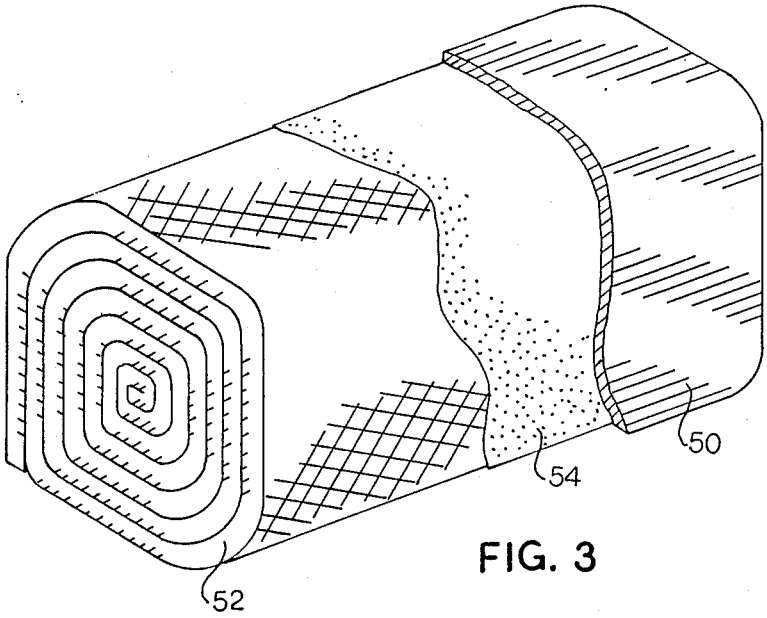
FIG. 3 depicts the tank of the present invention having a thermally conductive insert formed to provide a lattice within the tank which is adhered to the walls of the tank by a thermally conductive adhesive.

In accordance with the preferred embodiment of the invention there is shown in FIG. 3 a tank having side walls 50 and a thermal mesh insert 52. This insert is composed of a filler mass of a lattice construction which partially fills the volume of the tank while allowing space within its interstices for the fuel. A roll or stack of these lattice sheets is then formed into the shape of the tank (FIG. 3) and the assembly is adhered to the tank walls with a thermally conductive adhesive 54. An adhesive known as EC776 available from 3M Corporation has been used successfully and is resistant to degradation by the fuel. A more detailed description of this filler mass and the function of the thermal adherence is provided in U.S. Pat. No. 4,673,098 issued to on of the inventors herein.

Figure 4:
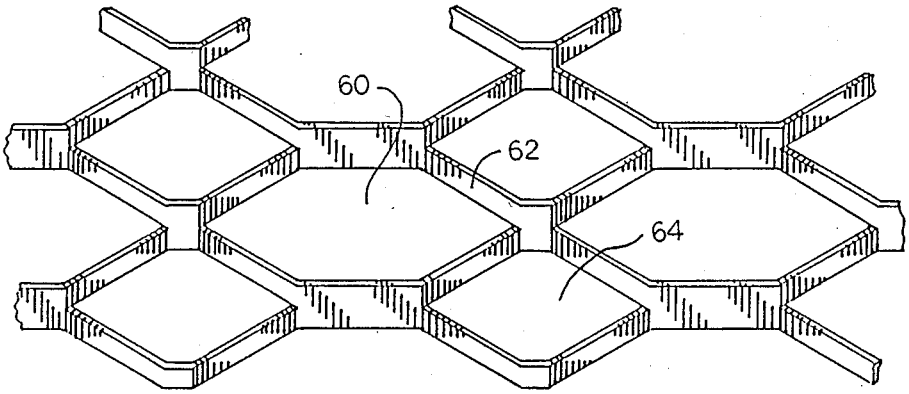
FIG. 4 is a view of the lattice sheet of the mesh insert of the tank apparatus showing the plurality of varied sized openings in accordance with a further feature of the invention.

The filler insert may be constructed of a slit sheet of thin metallic material, wherein the sheet is provided with an array of slits across its surface expandable into an array of openings 60 (FIG. 4). The expansion is accomplished by pulling the sheet at its periphery to open the slits into an array of diamond shaped openings. In such a lattice, transverse sides 62 are thereby created around the openings and are generally presented at an angled or inclined disposition relative to the apparent surface of the sheet. When such sheets are stacked or rolled, they will invariably nest together and their effectiveness is dramatically reduced as a result. Some previous attempts at preventing such nesting have resulted in fan folded configurations and reversing of layers; but the formation of such inserts are naturally expensive and time consuming. In order to provide an economical yet effective anti-nesting technique, there is utilized herein a method of creating an array of slits and openings of varying size, such that the openings (and their inclined sides) will not "match up" when layered. This may be accomplished by alternating various sized openings (60, 64), as shown, or creating a pseudo random array of multi-sized openings. In another version, dual sheets designed to be rolled or stacked together may be manufactured with one sheet having openings of one size and the other sheet having openings of another size to thereby prevent the match up of the side walls of the openings.

From the foregoing description it will be apparent that modifications can be made to the apparatus and method for using same without departing from the teachings of the present invention. Accordingly, the scope of the invention is only to be limited as necessitated by the accompanying claims.

We claim:

1. In a LPG fuel system for an internal combustion engine an improved fuel delivery apparatus comprising:

a tank member having thermally conductive walls and a thermally conductive filler insert in thermally conductive contact with said walls;

conduit means connected to said tank member for drawing vapor therefrom; and a pressure regulator connected to said conduit means for receiving vapor from said tank member and delivering vapor under a controlled pressure therefrom to the engine.

2. The fuel delivery apparatus of claim 1 wherein said thermally conductive filler insert comprises multiple layers of a metallic lattice sheet.

3. The fuel delivery apparatus of claim 1 wherein said thermally conductive insert is adhered to said tank walls.

4. The fuel delivery apparatus of claim 3 wherein said adhesive is thermally conductive.

5. The fuel delivery apparatus of claim 3 wherein said thermally conductive insert is comprised of a roll of a metallic lattice sheet.

6. The fuel delivery apparatus of claim 5 wherein said metallic lattice sheet presents an array of openings of a plurality of sizes.

7. The fuel delivery apparatus of claim 6 wherein said metallic lattice sheet is formed by slitting said sheet and expanding the openings.

8. A vaporizing tank apparatus for a LPG fuel system for an internal combustion engine comprising:

a tank member having thermally conductive walls;

a thermally conductive filler in thermally conductive contact with said tank walls, said filler having a lattice structure and formed to substantially conform to the shape of the tank, wherein fuel is allowed to circulate within the interstices of the lattice; and means for drawing vaporized fuel from said tank.

9. The vaporizing tank apparatus for a LPG fuel system for an internal combustion engine of claim 8 wherein said filler is comprised of multiple layers of a metallic lattice sheet.

10. The vaporizing tank apparatus for a LPG fuel system for an internal combustion engine of claim 9 wherein said thermally conductive filler is adhered to said tank walls with a thermally conductive adhesive.

11. The vaporizing tank apparatus for a LPG fuel system for an internal combustion engine of claim 10 wherein said metallic lattice sheet presents an array of openings of a plurality of sizes, and wherein said metallic lattice sheet is formed by slitting a thin foil sheet and expanding said slits into said openings.

12. A method of supplying vaporized LPG fuel to an engine comprising the steps of:

forming a thermally conductive filler from layers of metallic lattice sheet;

adhering said thermally conductive filler within a tank member having thermally conductive walls, said filler being arranged in thermally conductive relation with said walls;

drawing vaporized fuel from said tank.

13. The method of supplying vaporized LPG fuel to an engine of claim 12 wherein said filler is adhered to said tank walls with a thermally conductive adhesive.

14. The method of supplying vaporized LPG fuel to an engine of claim 13 wherein said metallic lattice sheet presents an array of openings of a plurality of sizes, and wherein said metallic lattice sheet is formed by slitting a thin foil sheet and expanding said slits into said openings.

* * * * *